US006318626B1

(12) United States Patent
St. Pierre et al.

(10) Patent No.: US 6,318,626 B1
(45) Date of Patent: Nov. 20, 2001

(54) RECLOSABLE PACKAGED FOOD CONTAINER

(75) Inventors: Dane T. St. Pierre, Cobourg; Daniel A. Thiemann, Toronto, both of (CA)

(73) Assignee: Kraft Canada Inc., Don Mills (CA)

( * ) Notice: Subject to any disclaimer, the term of this patent is extended or adjusted under 35 U.S.C. 154(b) by 0 days.

(21) Appl. No.: 09/454,961

(22) Filed: Dec. 3, 1999

(51) Int. Cl.[7] ..... B65D 5/60; B65D 5/72

(52) U.S. Cl. ..... 229/117.3; 229/117.27; 229/117.35; 229/222

(58) Field of Search ..... 229/117.27, 117.3, 229/117.33, 117.35, 222, 233, 234; 383/125, 906; 222/107, 529

(56) References Cited

U.S. PATENT DOCUMENTS

| | | | | |
|---|---|---|---|---|
| 2,898,027 | * | 8/1959 | Scholle | 229/234 |
| 3,136,471 | * | 6/1964 | Brastad | 229/222 |
| 3,139,227 | * | 6/1964 | Dorfman | 229/117.3 |
| 3,426,955 | * | 2/1969 | Olson | 229/117.3 |
| 3,477,632 | * | 11/1969 | Donahue | 229/222 |
| 3,498,522 | * | 3/1970 | Peet | 229/222 |
| 4,154,346 | * | 5/1979 | Heuberger | 229/117.27 |

* cited by examiner

*Primary Examiner*—Gary E. Elkins
(74) *Attorney, Agent, or Firm*—Thomas A. Marcoux

(57) ABSTRACT

A reclosable packaged food container, comprising an outer carton and an inner flexible liner. The outer carton has a generally semi-rigid construction, the inner liner is positioned inside the outer carton, and a supply of a food product is disposed in that liner. The outer carton includes a top wall that, in turn, includes first and second opposing top flaps. These flaps are movable between closed and open positions; and in the open position, the top flaps form a top opening, longitudinally extending only partly across the length of the top wall, to provide access to the inner liner. The inner liner includes a top edge and a top portion. That top edge is adapted to form a reclosable pour opening at the top of the top portion of the liner. In addition, the top portion of the liner is adapted to form a collapsible pouring spout extending only partly across the top edge of the liner and also extending through the top opening in the carton to dispense the food product from the liner. When the flaps of the carton are in the open position, the flaps extend upwardly from the top opening of the carton and form a spout guide to engage the top portion of the liner, on opposite sides thereof, to help form and to hold that top portion of the liner in the shape of the pouring spout.

9 Claims, 4 Drawing Sheets

RECLOSABLE PACKAGED FOOD CONTAINER

BACKGROUND OF THE INVENTION

This invention generally relates to reclosable packaged food containers, and more specifically, to containers of this type that are used to hold bulk food products such as cereal.

Bulk food products, such as cereal, are often sold to the consumer in semi-rigid, box-shaped containers, and these containers have achieved wide-spread commercial acceptance. Nevertheless, it is believed that these food containers can be improved.

For instance, when cereal is poured, or served, from a conventional cereal box, occasionally some cereal is spilled. There are a number of reasons for this. One reason is that cereal is often poured by very young children with, understandably, limited motor skills. Another reason is that cereal is often served and eaten in the early morning by persons who may not yet be fully alert. The design of the conventional cereal box may also contribute to this occasional spilling.

To elaborate, conventional cereal boxes include a semi-rigid outer carton having a box-shape, and an inner flexible liner or bag, and the cereal product is held in this inner liner. To open the box, the top of the outer carton and then the top of the inner liner are torn open. These box tops are usually designed to be torn open; and, for example, they may be provided with tear strips, perforated tear lines, or detachable flaps. The inner liner is typically torn open by tearing open the upper edge of that liner, usually along most or all of that edge. The above procedure results in a relatively large opening at the top of the inner liner and at the top of the cereal box. At the same time, the box and liner offer limited guidance for the cereal being poured out of the top opening. As a result, occasionally some of the cereal spills as it is poured out of the box.

In addition, with cereal boxes of the type described above, the tops of the boxes are commonly designed to be re-closed after cereal is served from a box. Among other reasons, these box tops are re-closed to help maintain the freshness of the product in the box and to help prevent that product from spilling out of the box in case the box is knocked over. Many consumers do try to close the box top after serving the cereal; however, these attempts are often not completely successful. Also, in many cases, a person will think that the box top is properly closed when in fact it is not.

SUMMARY OF THE INVENTION

An object of this invention is to improve packaged food containers.

Another object of the present invention is to provide a packaged food container, of the type having an outer carton and an inner liner, that is easy to open and that forms a pour spout as it is being opened. A further object of this invention is to provide a unique cereal carton having an easy open top flap feature that acts as a pour spout.

Still another object of the present invention is to provide a unique cereal carton having pour spout flaps with glue delamination zones for easy opening, and a cut score edge to assist during re-close.

These and other objectives are attained with a reclosable packaged food container, comprising an outer carton and an inner flexible liner. The outer carton has a generally semi-rigid construction, the inner liner is positioned inside the outer carton, and a supply of a food product is disposed in that liner. The outer carton includes a top wall that, in turn, includes first and second opposing top flaps. These flaps are movable between closed and open positions; and in the open position, the top flaps form a top opening, longitudinally extending only partly across the length of the top wall, to provide access to the inner liner.

The inner liner includes a top edge and a top portion. That top edge is adapted to form a reclosable pour opening at the top of the top portion of the liner. The top portion of the liner is adapted to form a collapsible pouring spout extending only partly across the top edge of the liner and also extending through the top opening in the carton to dispense the food product from the liner. In addition, when the flaps of the carton are in the open position, the flaps extend upwardly from the top opening of the carton and form a spout guide. In particular, these flaps engage the top portion of the liner, on opposite sides thereof, to help form and to hold that top portion of the liner in the shape of the pouring spout.

Preferably, the top edge of the liner includes first and second edge segments, and that top edge is opened along the first edge segment to form the pour opening. To facilitate opening the liner along this first segment, the liner may form a peelable seal area or the liner may be unsealed along this edge segment.

Further benefits and advantages of the invention will become apparent from a consideration of the following detailed description, given with reference to the accompanying drawings, which specify and show preferred embodiments of the invention.

DETAILED DESCRIPTION OF THE PREFERRED EMBODIMENTS

Figure 1:
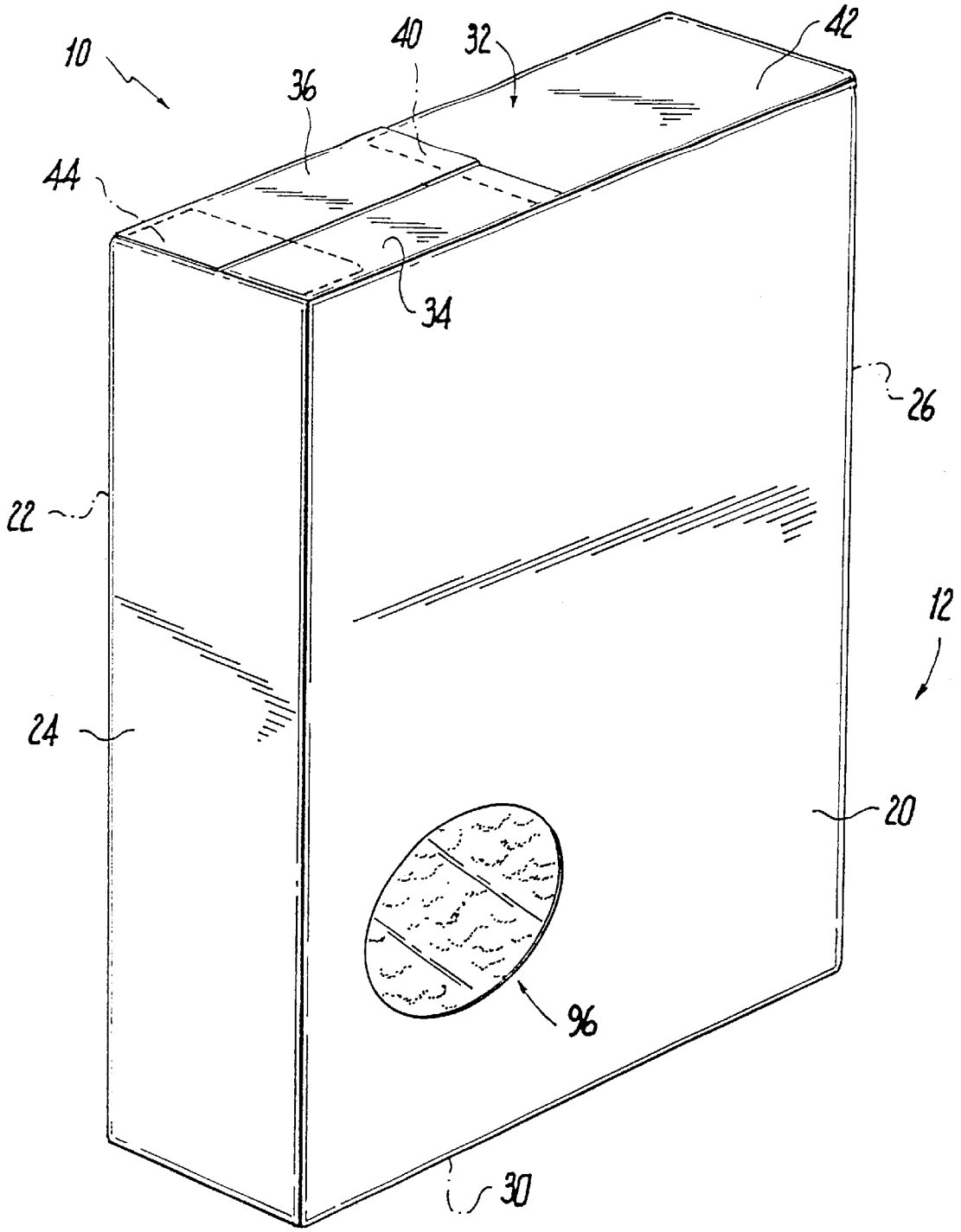
FIG. 1 is a perspective view of a packaged food container embodying this invention.
Figure 2:
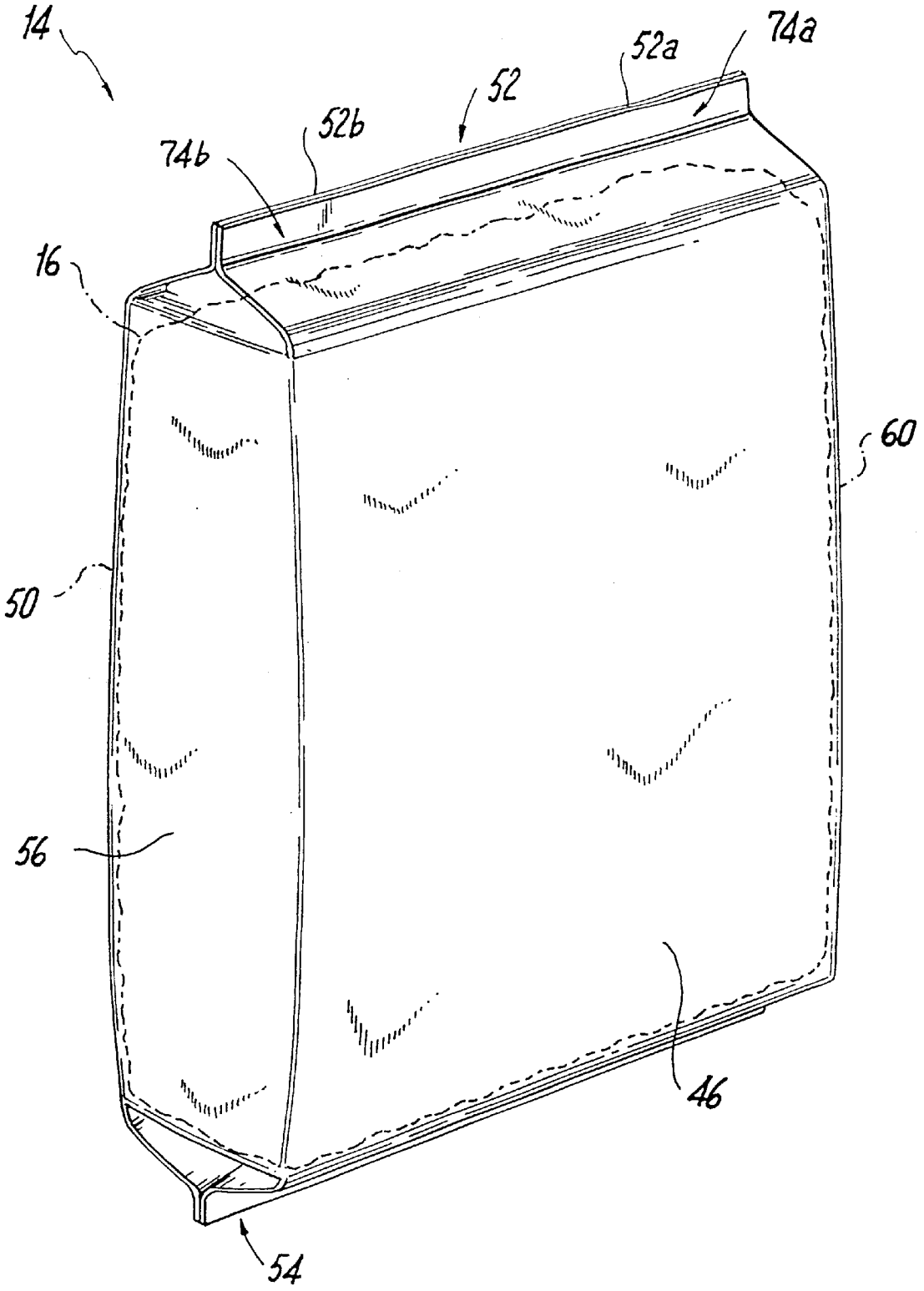
FIG. 2 is a perspective view of the inside liner of the container shown in FIG. 1.
Figure 3:
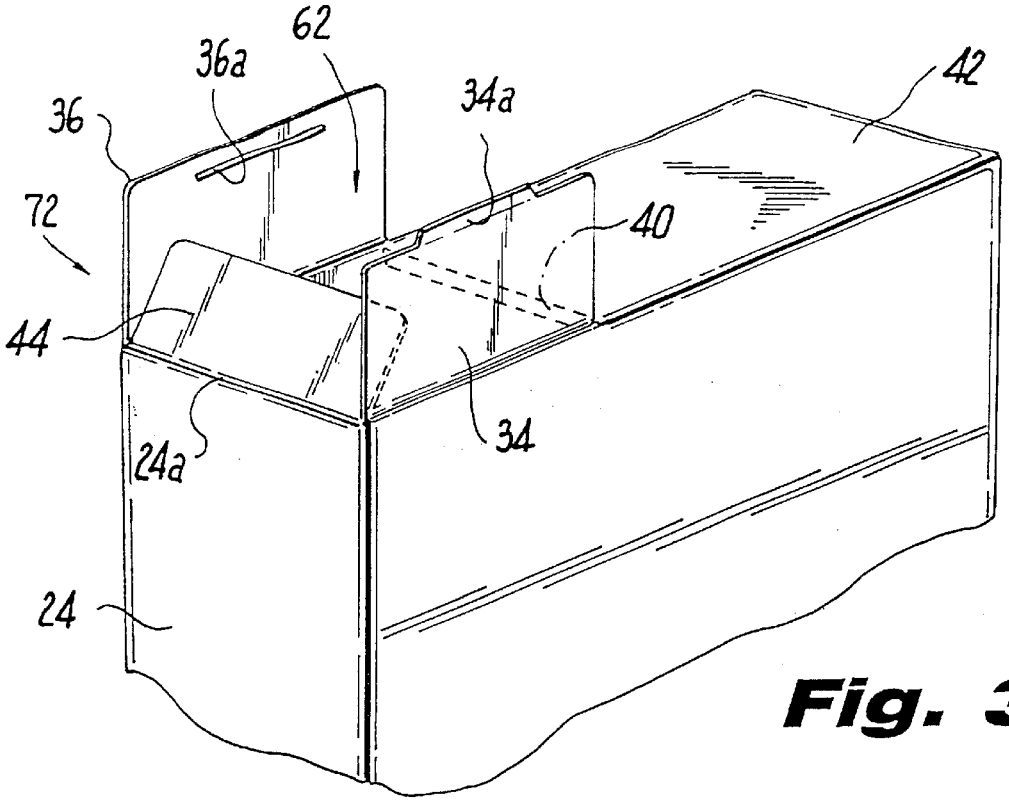
FIG. 3 is a perspective view showing the top of the container of FIG. 1 after the container has been opened.
Figure 4:
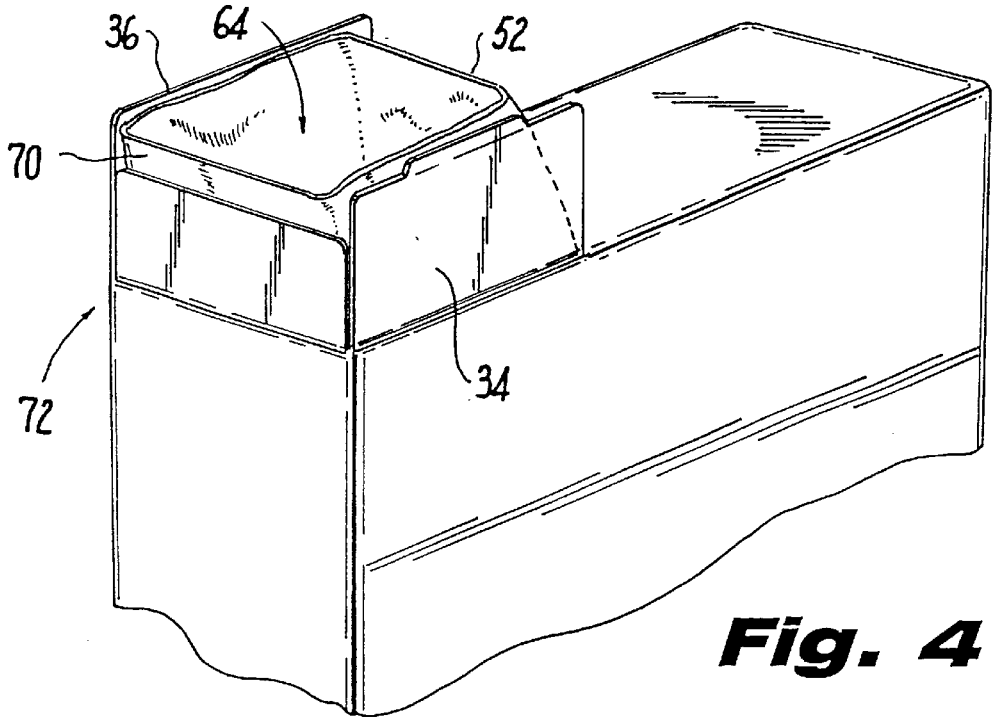
FIG. 4 shows the container after the box top and the top of the inner liner have been opened and formed into a pouring spout.

FIGS. 1 through 4 illustrate container 10 comprising outer carton 12 and flexible inner liner or bag 14. Generally, outer carton 12 has a semi-rigid construction, inner liner 14 is positioned inside the outer carton, and a supply of a food product 16 is disposed in the liner.

With the embodiment of container 10 illustrated in FIG. 1, carton 12 has a generally box-shape, and includes front wall 20, back wall 22, side walls 24 and 26, bottom wall 30 and top wall 32; and this top wall, in turn, includes first and second opposing transverse flaps 34 and 36, undercut portion 40, end member 42, and end flap 44. Also, with this embodiment of container 10, liner 14 has a generally rectangular configuration, including front side 46 and back side 50, and these sides form top edge 52, bottom edge 54, left side 56 and right side 60.

In accordance with this invention, flaps 34 and 36 are movable between a closed position (shown in FIG. 1) and an open position (shown in FIGS. 3 and 4); and in the open position, these flaps form a top opening 62, longitudinally extending only partially across top wall 32, to provide access to the inner liner 14. At the same time, top edge 52 of inner liner 14 is adapted to form a reclosable pour opening 64 extending only partly across the top edge; and liner 14, specifically a top portion thereof, is adapted to form a collapsible pouring spout 70. This pouring spout 70 extends only partly across the top edge 52 of the liner and also extends through top opening 62 in the carton to dispense the food product from the liner. In addition, when the flaps 34 and 36 are in the open position, the flaps extend upwardly from the top opening 62 of carton 12 and form a spout guide 72. In particular, these flaps engage the top portion of the liner, on opposite longitudinal sides thereof, to help form and to hold that top portion of the liner in the shape of the pouring spout.

More particularly, flaps 34 and 36 are connected to container sidewalls 20 and 22, specifically to the top edges thereof, for folding movement between the closed and open positions. In the closed position, the flaps 34 and 36 are generally perpendicular to sidewalls 20 and 22, and the flaps extend over and cover portions of the container top, closing opening 62. In the open position, flaps 34 and 36 are generally co-planar with, and extend upward from, sidewalls 20 and 22.

Preferably, flaps 34 and 36 include means to hold the flaps releasably connected together in the closed position. This holding means allows a user repeatedly to disconnect the flaps from, and to reconnect the flaps to, each other. With the embodiment of container 10 shown in FIGS. 1 through 4, this holding means comprises a tab 34*a* extending outward from flap 34, and a slit 36*a* formed in flap 36. To connect flaps 34 and 36 together, tab 34*a* is inserted into slit 36*a;* and to disconnect the flaps 34 and 36 from each other, tab 34*a* is pulled out of slit 36*a*.

Under cut portion 40 longitudinally extends beneath flaps 34 and 36, and this portion 40 applies a pressure to flaps 34 and 36 when those flaps are being closed and reconnected to each other. This pressure causes an audible sound, and specifically a click, to be produced when the flaps 34 and 36 (with tab 34*a* and slit 36*a* already engaged) are pressed into contact with and finally engage with the undercut portion 40. This click confirms to the user that the flaps have been properly reconnected together. As particularly shown in FIG. 3, undercut portion 40 is integrally connected to and longitudinally extends outward from end member 42.

End flap 44 helps to close the box top, helps to hold flaps 34 and 36 in their open position, and also helps to form spout guide 72. More specifically, flap 44 is foldably connected to sidewall 24, and in particular, to the top edge 24*a* thereof; and in use, the end flap is folded between its own closed and open positions. In the closed position (shown in dotted lines in FIG. 1), flap 44 extends outward from edge 24*a,* perpendicular to sidewall 24, and the end flap extends over a portion of the top of the container, immediately below flaps 34 and 36. In this way, the flap 44 helps form a complete cover over the container top, specifically the left end thereof. In the open position, shown in FIGS. 3 and 4, flap 44 extends upwards from edge 24*a,* between flaps 34 and 36, and the end flap help to hold flaps 34 and 36 in upwardly extending positions.

Liner 14, as mentioned above, has a generally rectangular configuration, including front and back sides 46 and 50, left side 56, right side 60, top edge 52 and bottom edge 54. Also as mentioned above, top edge 52 of inner liner 14 is adapted to form reclosable pour opening 64; and the liner, specifically the top portion thereof, is adapted to form collapsible pouring spout 70.

Preferably, liner opening 64 is formed by opening the liner 14 along only a part of top edge 52, and the liner may be provided with any one or more of a number of features to facilitate opening the liner in this way. For example, with the liner shown in FIG. 2, a permanent seal area 74*a* is formed along a first segment 52*a* of the top edge, a peelable seal area 74*b* is formed along a second segment 52*b* of the top edge, and opening 64 is formed by peeling open that second segment 52*b* of the top edge.

This peelable area 74*b* may be of the type that enables the user to peelably reseal the second segment 52*b* of the top edge, or seal area 74*b* may be of the type that is not designed to be peelably resealed by the consumer. In the latter case, the second segment 52*b* of top edge 52 may be re-closed by the consumer by folding the tops of the sides of the liner over each other along top edge 52. Alternatively, the second segment 52*b* of the top edge 52 may be unsealed, and the liner opening 64 may be formed by pulling apart the front and back sides of the liner along that edge segment. With this arrangement, the second segment of the top edge may be re-closed by the consumer by folding the tops of the two sides of the liner over each other along top edge 52.

Liner 14 may be designed in any one of a number of ways in order to form pouring spout 70. For instance, with reference to FIG. 2, the liner may have a length that is appreciably greater than the height of outer carton 12; and when this liner is positioned inside the carton, the top of the liner is folded over, or otherwise compacted, to fit inside the carton. Then, to form spout 70 the top portion of the liner 14 is pulled up or unfolded outward through opening 62.

Figure 5:
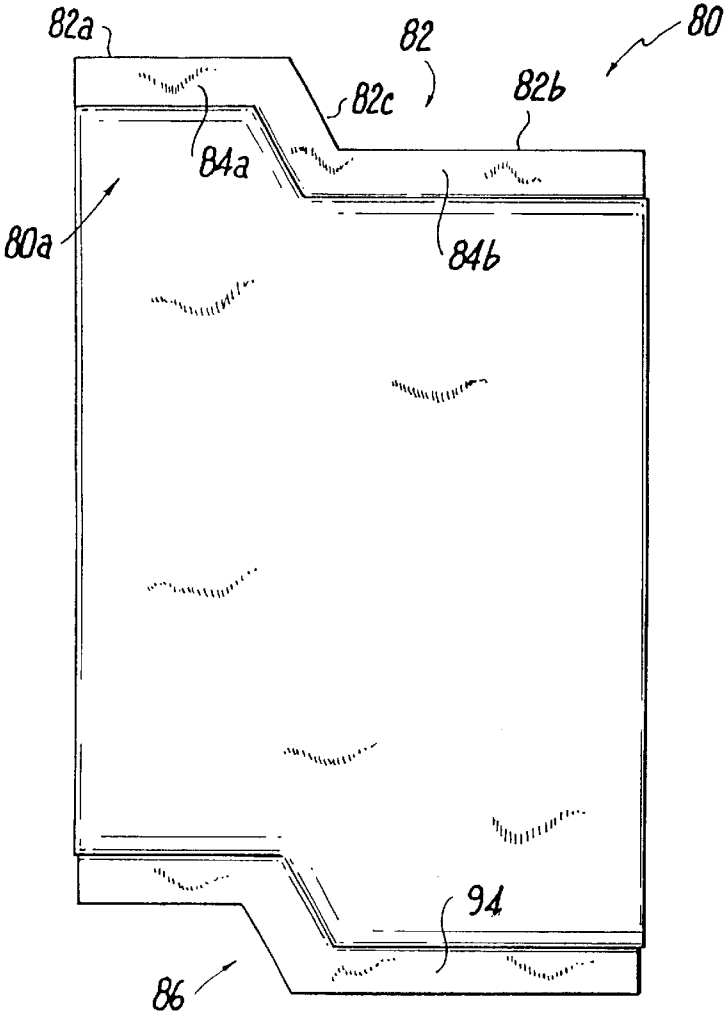

FIG. 5 illustrates an alternate liner 80 that includes an extended or offset portion 80*a* used to form pouring spout 70. More specifically, with this embodiment of the liner, the top edge 82 of the liner includes first, second and third segments 82*a,* 82*b* and 82*c.* First and second segments 82*a* and 82*b* are longitudinally offset from each other, with the first segment longitudinally positioned outward of the second segment. Also, with this embodiment, segments 82*a* and 82*b* are parallel to each other and are connected together by third segment 82*c.* In use, this liner is positioned inside carton 12, with extended portion 80*a* located directly below flaps 34 and 36. Pouring spout 70 is formed by, after flaps 34 and 36 are opened, pulling extended portion 80*a* outward through carton opening 62, opening the top edge of the liner along segment 82*a* or segments 82*a* and 82*c,* and pulling the sides of the liner apart along the top edge to form the pouring spout.

Figure 6:
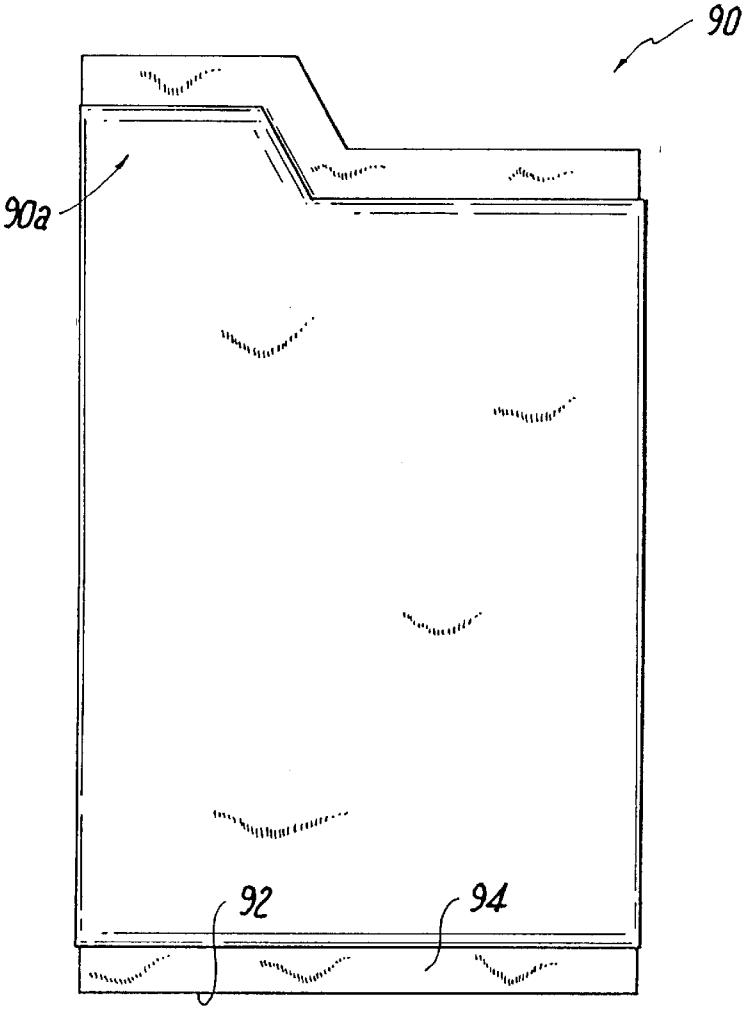
FIGS. 5 and 6 schematically show alternate inside liners that may be used in the container of FIG. 1.

To help pull th e top edge of the liner apart along segment 82*a* or segments 82*a* and 82*c,* preferably a peelable seal area 84*a* is formed along segment 82*a* or segments 82*a* and 82*c,* and a permanent seal area 84*b* is formed along segment 82*b.* Alternatively, the top edge of the liner in the pour spout area 82*d* may be left unsealed above segment 82*a* or segments 82*a* and 82*c.* Also, it may be noted that, when liner 80 is provided with an extended portion 80*a,* preferably the top edge 82 and bottom edge 86 of the liner have identical shapes. This simplifies the manufacture of the liner, and results in a more efficient use of the material from which the liner is made. Alternatively, as shown in FIG. 6, the present invention may utilize liner 90 having offset portion 90*a* and a straight bottom edge 92. In both of the examples shown in FIGS. 5 and 6, however, preferably, a permanent seal area 94 is formed along the bottom edge of the liner.

Carton 12 and liner 14 may be made in any suitable manner. For example, carton 12 is preferably made from a blank that is provided with the fold lines and the cut lines needed to form the carton. Preferably, this blank includes two top panels that are folded over one another to form top wall 32, and in particular to form flaps 34 and 36, undercut portion 40 and end member 42. These top panels are transversely precut so that, when the panels are folded over as described above, flaps 34 and 36 are separated from end member 42 by cut line 42*a*. Also, these top panels are cut so as to form undercut portion 40. In addition, when the panels are folded over to form top wall 32, preferably, the sections of the panels that are connected together to form end member 42 are permanently attached together, while the sections of the panels that become flaps 34 and 36 are attached together in a manner, for example by glue delamination zones, that allows the consumer easily to detach the flaps from each other.

To make liner 14, a supply of liner material is provided, and that material is cut completely across and through in the transverse direction at regular spaced intervals to cut the liner material into a multitude of individual liners. The original liner material may have a flat, single sheet configuration, in which case the sheet is folded and the longitudinal edges of the sheet are connected together to form a tubular configuration. Alternatively, the original liner material may have a flattened tubular configuration.

After a liner is cut, the bottom edge of the liner (tube) is sealed, the liner is filled with a food product, the top edge of the liner is sealed and simultaneously the package is cut from the tube, the filled liner is placed in carton 12, and carton 12 is closed.

Food package 10 may be provided with additional features. For instance, the liner may be made of a transparent material, and an opening 96 may be made in the front wall 20 of carton 12. This arrangement allows a consumer to see the attributes of the food product through the carton display window prior to purchase.

Carton 12 and liner 14 may be made of any suitable materials. For example, the carton may be made from a natural Kraft carton board provided with an embossed finish. This carton offers a unique look and feel, and both the carton and liner can be made so that they are easy to open.

Many types of food products can be held in container 10. As indicated above, container 10 is very well suited for use with cereal products, but other products such as pretzels, nuts, candies, pasta and even some fruits and vegetables can be held and sold in containers embodying the present invention.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A reclosable packaged food container, comprising:

an outer carton of generally semi-rigid construction;

an inner flexible liner positioned inside the outer carton; and a supply of a food product disposed in the liner;

wherein the outer carton includes a top wall having a width and a length, said top wall including first and second opposing top flaps movable between closed and open positions, in the open position, the top flaps form a top opening longitudinally extending only partly across the length of the top wall to provide access to the inner liner;

wherein the inner liner includes a top edge and a top portion, said top edge is adapted to form a reclosable pour opening at the top of said top portion, and said top portion is adapted to form a collapsible pouring spout extending only party across said top edge and also extending through the top opening in the carton to dispense the food product from the liner;

wherein when the flaps we in the open position, the flaps extend upwardly from the top opening of the carton and form a spout guide to engage said top portion of the liner, on opposite longitudinal sides thereof, to help form and to hold said top portion of the liner in the shape of the pouring spout; and wherein the top wall of the carton further includes an undercut portion longitudinally extending beneath the first and second flaps;

the first and second flaps include means to hold the flaps releasably connected together to allow a user repeatedly to disconnect the flaps from, and to reconnect the flaps to, each other; and the undercut portion applies a pressure to the flaps when the flaps are being reconnected to each other, and said pressure causes an audible sound to be produced when the flaps are reconnected together.

2. A container according to claim 1, wherein:

the top wall of the carton further includes an end member longitudinally extending across a major portion of the container top; and the undercut portion is integrally connected to and longitudinally extends outward from said end member.

3. A container according to claim 2, wherein:

the outer carton further includes a front wall and a back wall;

the first and second flaps are foldably connected to the front and back walls respectively;

the first and second flaps have lengths substantially equal to the length of the pouring spout, and the first and second flaps engage the sides of the pouring spout along substantially the complete length of the pouring spout.

4. A container according to claim 1, wherein:

the top edge of the liner includes first and second edge segments; and the top edge of the liner is opened along said first segment to form the pour opening.

5. A container according to claim 4, wherein:

along the first segment of the top edge, the liner is unsealed to facilitate opening the liner along said first segment; and along the second segment of the top edge, the liner forms a permanent seal area.

6. A container according to claim 4, wherein the first and second segments of the top edge of the liner are longitudinally offset from each other, with the first segment longitudinally extending outward of the second segment.

7. A container according to claim 4, wherein the liner further includes a bottom edge, and the top and bottom edges of the liner have identical shapes to facilitate forming the liner.

8. A container according to claim 4, wherein the first and second segments of the liner are co-linear, and the top edge of the liner forms a substantially straight edge.

9. A reclosable packaged food container, comprising:

an outer carton of generally semi-rigid construction;

an inner flexible liner positioned inside the outer carton; and a supply of a food product disposed in the liner;

wherein the outer carton includes a top wall having a width and a length, said top wall including fist and second opposing top flaps movable between closed and open positions, in the open position, the top flaps form a top opening longitudinally extending only partly across the length of the top wall to provide access to the inner liner;

wherein the inner liner includes a top edge and a top portion, said top edge is adapted to form a reclosable pour opening at the top of said top portion, and said top portion is adapted to form a collapsible pouring spout extending only partly across said top edge and also extending through the top opening in the carton to dispense the food product from the liner;

wherein when the flaps are in the open position, the flaps extend upwardly from the top opening of the carton and form a spout guide to engage said top portion of the liner, on opposite longitudinal sides thereof, to help form and to hold said top portion of the liner in the shape of the pouring spout; and wherein:

the top edge of the liner includes first and second edge segments;

the top edge of the liner is opened along said first segment to form the pour opening;

along the first segment of the top edge, the liner forms a peelable seal area to facilitate opening the liner along said first segment; and along the second segment of the top edge, the liner forms a permanent seal area.

* * * * *